US005709366A

United States Patent [19]

Speece

[11] Patent Number: 5,709,366

[45] Date of Patent: Jan. 20, 1998

[54] FENCE POST SUPPORT

[75] Inventor: Stephen Speece, Youngstown, Ohio

[73] Assignee: Steel City Corporation, Youngstown, Ohio

[21] Appl. No.: 674,913

[22] Filed: Jul. 3, 1996

[51] Int. Cl.[6] ..... A45F 3/44

[52] U.S. Cl. ..... 248/530; 248/156; 248/545; 52/165

[58] Field of Search ..... 248/156, 530, 248/545; 52/165, 155

[56] References Cited

U.S. PATENT DOCUMENTS

| | | | |
|---|---|---|---|
| 1,672,927 | 6/1928 | Burk | 52/165 |
| 3,241,798 | 3/1966 | Nestor | 248/156 |
| 3,342,444 | 9/1967 | Nelson | 248/156 X |
| 3,797,260 | 3/1974 | Webb | 52/155 X |
| 4,249,715 | 2/1981 | Repp . | |
| 4,850,555 | 7/1989 | Lemkin et al. | 248/156 X |
| 4,874,149 | 10/1989 | Miceli . | |
| 4,923,164 | 5/1990 | Stenberg . | |
| 5,340,065 | 8/1994 | Thomas . | |
| 5,349,775 | 9/1994 | Mondares | 248/530 X |
| 5,479,880 | 1/1996 | Stuhr et al. | 248/156 X |
| 5,586,742 | 12/1996 | Carter | 248/545 |

*Primary Examiner*—Peter M. Cuomo
*Assistant Examiner*—Hank V. Tran
*Attorney, Agent, or Firm*—Harpman & Harpman

[57] ABSTRACT

A fence post support for securing a synthetic resin fence post in the ground in a vertical position. The fence post support comprises a ground engaging spike whose upper portion receives the end of the fence post thereover and which can be expanded wedgeably securing the post on the support. A pounding plate is provided for driving the post support into the ground.

8 Claims, 2 Drawing Sheets

FENCE POST SUPPORT

BACKGROUND OF THE INVENTION

1. Technical Field

This device relates to post supports and the like that are used to secure posts in the ground by providing a separate ground engagement element to which the post is secured.

2. Description of Prior Art

Prior art devices of this type have generally relied on hollow upper sections to receive the post and a ground engagement spike extending therefrom. Typically, these devices require a driving block that is temporarily inserted into the hollow post receiving area and then driven into the ground. The drive block is then replaced with the post which is secured by multiple fasteners. Other ground engagement post supports rely on a variety of different post engagement configurations, see for example U.S. Pat. Nos. 4,249,715, 4,874,149, 4,923,164 and 5,340,065.

In U.S. Pat. No. 4,249,715 it is directed towards a sign application in which a tubular post member is positioned over a closure member by movably positioning on an upstanding drive base by a threaded fastener assembly. The assembled mounted post is held to a ground engagement stake by a spring clip.

U.S. Pat. No. 4,874,149 is directed to a post support having a ground engaging spike and a hollow post receiving container with a pair of wedgeable end caps that engage respective open edges of the container securing same about a post.

U.S. Pat. No. 4,923,164 shows a post support and anchor device with a break-away post engagement portion with a rubber retainer interconnector.

A support post for an outdoor sign is illustrated in U.S. Pat. No. 5,340,065 having a hinged upper portion and a ground engaging portion. The sign post is fitted over the ground engaging portion in a simple non-interference fit.

SUMMARY OF THE INVENTION

This invention relates to a fence post support anchor device wherein a post support is formed from a pair of angle irons secured to one another along a tapered ground engagement portion and selectively expanded in a post engagement portion over which the hollow synthetic resin fence post is positioned. The post support is driven vertically into the ground leaving the post support portion exposed for rapid insertion thereon of the hollow fence post. The integral post engagement portion is expandable by spreading the angle irons apart at their exposed ends wedgeably securing against the inside of the hollow fence post positioned thereover by advancement of a fastener therebetween.

DESCRIPTION OF THE PREFERRED EMBODIMENT

Figure 1:
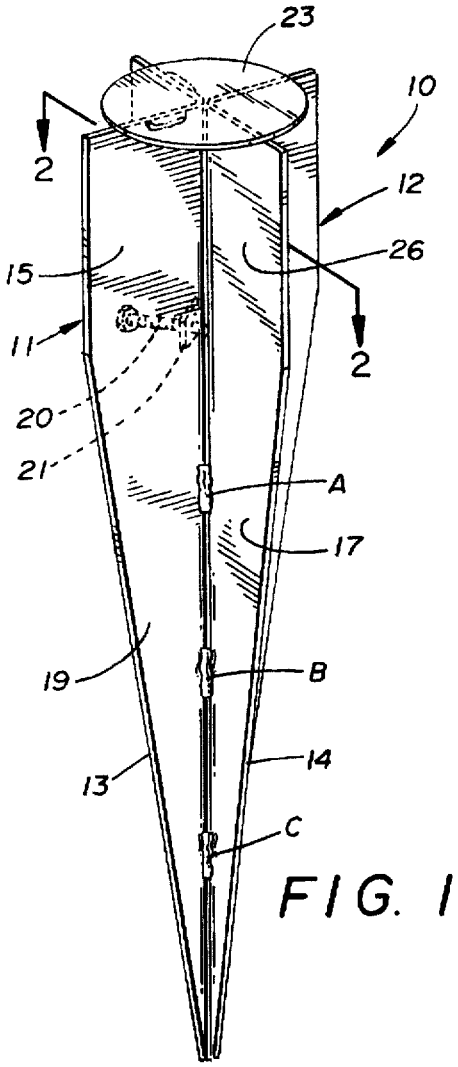
FIG. 1 is an illustrated perspective view of the post support of the invention.
Figure 2:
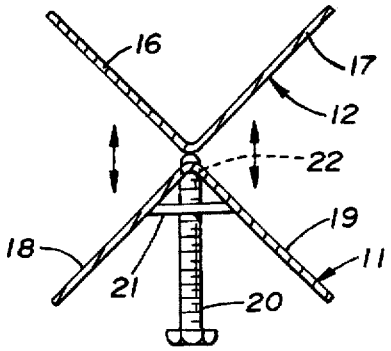
FIG. 2 is an enlarged cross-sectional view on lines 2—2 of FIG. 1.
Figure 3:
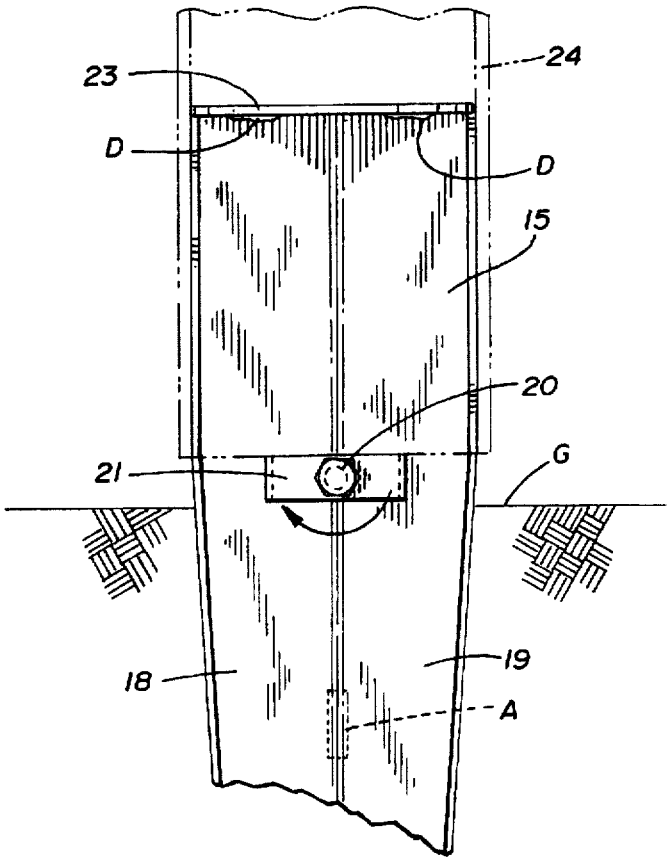
FIG. 3 is a partial side elevational view with a portion broken away illustrating the adjustable expansion element with a fence post shown in broken lines positioned thereon.
Figure 4:
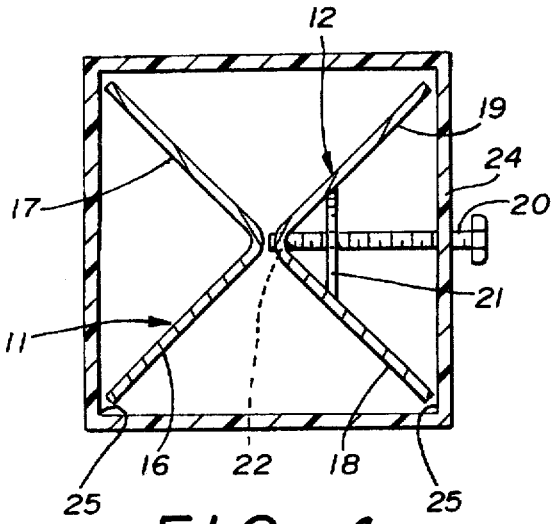
FIG. 4 is an enlarged cross-sectional view of the post engagement portion of the invention with the fence post positioned thereover in unsecured position.

Referring to FIGS. 1, 2, and 3 of the drawings, a fence post support 10 can be seen having a pair of elongated angle irons 11 and 12 with respective tapered portions 13 and 14 and post engagement portions 15 and 26. The angle irons 11 and 12 are positioned together to form a orthothotical arrangement defining multiple opposing ground engagement blades 16, 17, 18, and 19 respectively. The angle irons 11 and 12 are welded in parallel spaced relation to one another along the tapered portions 13 and 14 at longitudinally spaced points designated at A, B, and C. A threaded expansion element 20 is positioned in a registering mounting bracket 21 on said angle iron 11 between the respective blades 18 and 19 of the post supporting portion with an aligned aperture therein at 22, best seen in FIGS. 2 and 3 of the drawings. The mounting bracket 21 is adjacent the transition point between the tapered portion 13 and post engagement portion 15.

A drive plate 23 is positioned on the free ends of the angle iron's post engagement portions 15 and 26 and is secured in this example to the free end of the post engagement portion 15 by welding at D.

Referring now to FIGS. 3, 4, 5, and 6 of the drawings, the fence post support 10 can be seen in use wherein a hollow synthetic resin fence post 24 is to be secured over the post engagement portions 15 and 26. The fence post support 10 is driven into the ground G, best seen in FIG. 3 of the drawings by the drive plate 23 and the fence post 24 is then slipped over as best seen in broken lines in FIGS. 3–6 and in solid lines in FIGS. 4 and 5.

Figure 5:
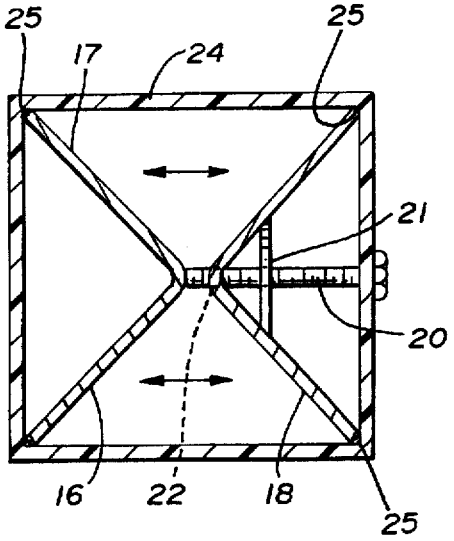
FIG. 5 is an enlarged cross-sectional view of the post engagement portion shown in FIG. 4 in expanded fence post engagement position.
Figure 6:
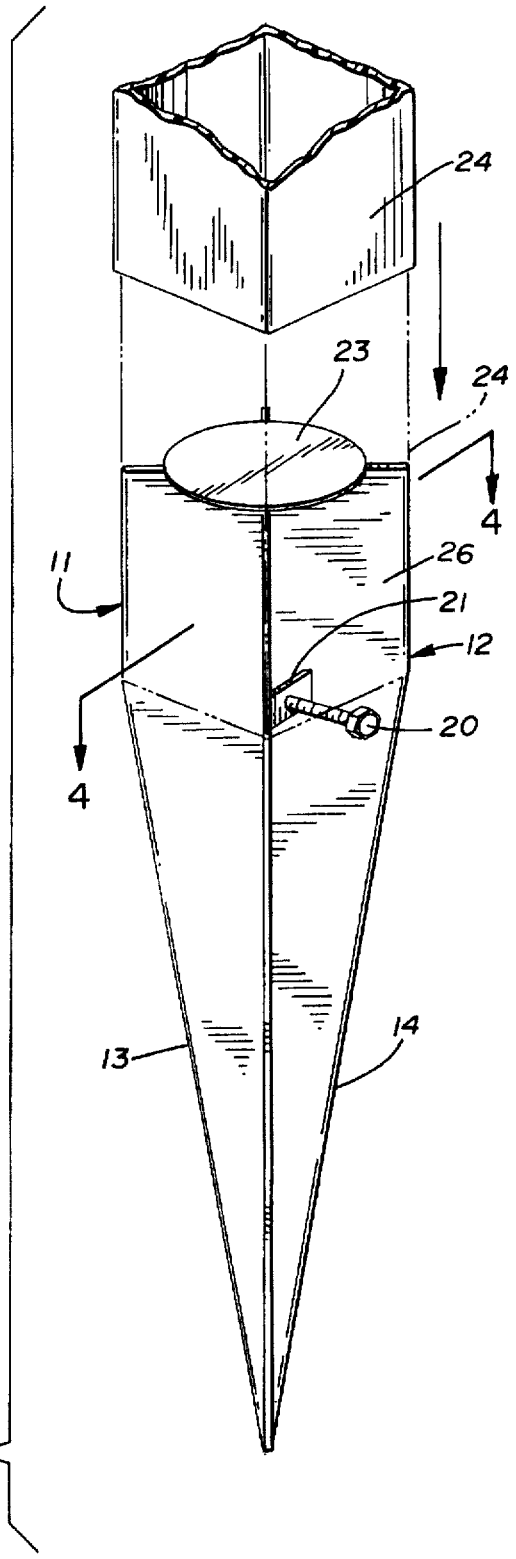
FIG. 6 is an expanded illustrated perspective view of the post support with a fence post positioned thereabove for insertion thereon as indicated in broken lines.

The threaded expansion element 20 acts as a stop for the fence post 24 properly positioning it over the generally vertically aligned spaced angle irons 11 and 12 of the post engagement portions 15 and 26. The threaded expansion element 20 is threadably advanced in the mounting bracket 21 through the aperture at 22 engaging the corresponding angle iron post engagement portion 26 spreading the adjacent angle irons apart forcing same against the inner surface of the fence post 25 as illustrated in FIG. 5 of the drawings wedgeably securing same.

It will be noted that as the angle irons 11 and 12 spread apart and the blades 16–19 of the post engagement portions 15 and 26 wedgeably engage respective inner corners 25 of the fence post 24, they impart a continuous contact surface over the length of the engagement portions. The amount of transverse displacement between the angle irons is relatively small given the initial close tolerance between the interior dimensions of the fence post 24 and the exterior dimensions of the post engagement portions 15 and 26 and respective blades 16–19 of the post support 10.

It will further be evident that the fence post 24 can be removed from the fence post support 10 by disengagement of the expansion element 20 thus relieving the friction fit between the multiple blades and the inside corners 25 of the fence post 24 as hereinbefore described.

It will further be apparent that the welding point A of the angle irons 11 and 12 is positioned in spaced relation below the transition point of the fence post engagement portion and the ground engagement portion so as to provide for sufficient flex in the related angle irons as they are expanded by the threaded expansion element 20 which will be well understood by those skilled in the art.

Thus it will be seen that a new and useful fence post support has been illustrated and described and it will be apparent to those skilled in the art that various changes and modifications may be made therein without departing from the spirit of the invention.

Therefore I claim:

1. A fence post support which secures a hollow fence post in the ground in a vertical generally upright position comprises: a ground engaging portion and a post engagement portion, said ground engaging portion comprises a pair of elongated tapered members secured to one another to be driven vertically into the ground, said post engagement portion having a pair of upstanding vertical aligned angles, means for selectively spreading said angles in relation to one another, and means for driving said ground engagement portion into said ground.

2. The fence post support of claim 1 wherein said angles comprise angle irons in spaced parallel relation to one another.

3. The fence post support of claim 1 wherein said means for selectively spreading said angles in relation to one another comprises an expansion element threadably engaged within a mounting bracket on one of said upstanding angles of said post engagement portion and rotatably extended to engage said other of said angles.

4. The fence post support of claim 1 wherein said means for driving said ground engagement portion into the ground comprises: a drive plate secured to said post engagement portion.

5. The fence post support of claim 1 wherein said elongated tapered members further comprise: elongated L-shaped channel elements in spaced parallel relation to one another defining multiple oppositely disposed ground engaging blades.

6. The fence post support of claim 1 wherein said ground engagement portion and said post engagement portion are integral and said post engagement portion defining multiple upstanding oppositely disposed post interengagement blades.

7. The fence post support of claim 1 wherein said fence post is made of synthetic resin material.

8. The fence post support of claim 1 wherein said hollow fence post is of a known interior dimension and said fence post support portion defines an overall exterior dimension less than that of said known fence post interior dimension.

* * * * *